United States Patent [19]

Schilger

[11] Patent Number: 4,566,240

[45] Date of Patent: Jan. 28, 1986

[54] COMPOSITE FLOOR SYSTEM

[76] Inventor: Herbert K. Schilger, 32 Castleglen Ct., NE., Calgary, Alberta T3J 2B8, Canada

[21] Appl. No.: 587,542

[22] Filed: Mar. 8, 1984

[30] Foreign Application Priority Data

Mar. 11, 1983 [CA] Canada ..... 423447

[51] Int. Cl.[4] ..... E04B 1/18

[52] U.S. Cl. ..... 52/414; 52/39; 52/723; 52/334; 52/699

[58] Field of Search ..... 52/414, 39, 723, 724, 52/340, 720, 334, 699, 711, 698

[56] References Cited

U.S. PATENT DOCUMENTS

| | | | |
|---|---|---|---|
| 757,962 | 4/1904 | Randall | 52/724 |
| 1,768,246 | 6/1930 | Gaddis | 52/699 |
| 2,065,493 | 12/1936 | Greulich | 52/723 X |
| 2,558,946 | 7/1951 | Fromson | 52/723 X |
| 3,686,819 | 8/1972 | Atkinson | 52/724 X |
| 3,769,774 | 11/1973 | Barnes | 52/39 X |

FOREIGN PATENT DOCUMENTS

| | | | |
|---|---|---|---|
| 874180 | 6/1971 | Canada | 72/39 |
| 885156 | 11/1971 | Canada | 20/45 |
| 892892 | 2/1972 | Canada | 72/39 |
| 1008691 | 4/1977 | Canada | 72/39 |
| 517916 | 5/1921 | France | 52/39 |
| 1093058 | 11/1954 | France | 52/724 |

*Primary Examiner*—J. Karl Bell

[57] ABSTRACT

A novel composite floor system is described, together with a specific metallic reinforcing and support section for use in the floor system. The system comprises a concrete slab and a metallic reinforcing and support section mechanically embedded in the slab. The support section comprises an elongated unitary strip having a substantially flat central web portion containing a plurality of spaced holes, a pair of substantially flat leg portions extending away from the sides of said web and an edge flange extending outwardly from the outer end of each leg portion, with at least the leg portions and the edge flanges being embedded in the concrete with the web adjacent the face of the slab. Support bolts are mounted within the web portion holes and extend outwardly from the slab. These bolts can be used to support a formwork for the pouring of the concrete slab.

5 Claims, 7 Drawing Figures

COMPOSITE FLOOR SYSTEM

This invention relates to a composite floor system and, in particular, to a system comprising a concrete slab and a metallic reinforcing and support section mechanically embedded in the slab.

In the construction of commercial buildings, concrete floor slabs are poured on a supporting formwork. After the floor slab has set, the formwork is normally removed and reused to produce another slab.

For fire safety, these floor slabs are normally formed without any holes extending all the way through so that each floor of a building is totally sealed from the next floor. Of course, beneath each floor slab is normally placed a suspended ceiling structure which is suspended from the floor slab.

It is also commonplace to reinforce such concrete floor slabs by including steel mesh, embedded reinforcing beams, etc.

It is the object of the present invention to provide an improved form of composite floor system in which a reinforcing beam can also serve as a versatile supporting member for both the formwork used in pouring a floor slab and the suspended ceiling system which may be used after the slab has been poured.

Thus, one feature of the present invention is a composite floor system comprising a concrete slab and a metallic reinforcing and support section mechanically embedded in the slab. This support section comprises an elongated unitary strip having a substantially flat central web portion containing a plurality of spaced holes, a pair of substantially flat leg portions extending away from the sides of the web and an edge flange extending outwardly from the outer end of each leg portion. At least the leg portions and the edge flanges are embedded in the concrete with the web being adjacent a face of the slab and the support bolts mounted within the web portion holes and extending outwardly from the slab.

The support bolts can support formwork for receiving cement-aggregate slurry to make the concrete slab.

According to another feature of the invention, the metallic reinforcing and support section for mechanically embedding in the floor slabs comprises an elongated unitary strip having a substantially flat central web portion, a pair of substantially flat leg portions extending away from said web and a pair of edge flanges extending outwardly from the pair of leg portions. The web portion has a plurality of spaced holes to receive support bolts and said flanges have longitudinally spaced rounded depressions of small radius pressed downwardly therein with the portions of the longitudinal flanges between these depressions being upwardly bowed.

Certain preferred embodiments of the present invention are illustrated by the attached drawings in which.

Figure 1:
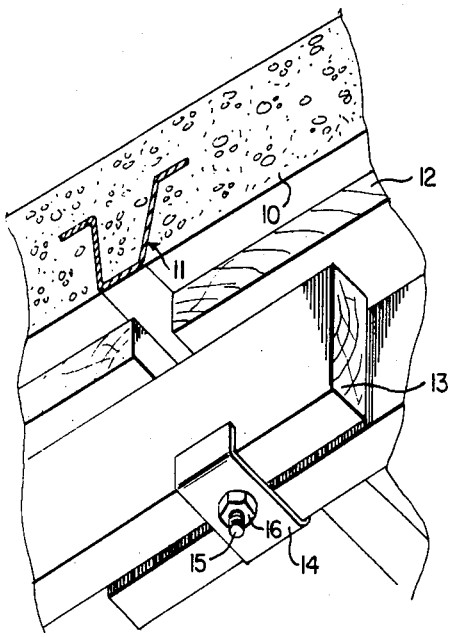
FIG. 1 is an isometric view of an assembled floor system according to this invention.

As will be seen from FIG. 1, a floor system of the present invention includes a concrete slab 10 which has embedded therein a metallic reinforcing and support section 11. Mounted below this reinforcing and support section 11 is a formwork consisting of plywood sheets 12 supported by wooden beams 13. The plywood is sandwiched between the support sections 11 and the wooden beams 13 and held together by means of bolts 15, nuts 16 and steel support plates 14.

Figure 2:
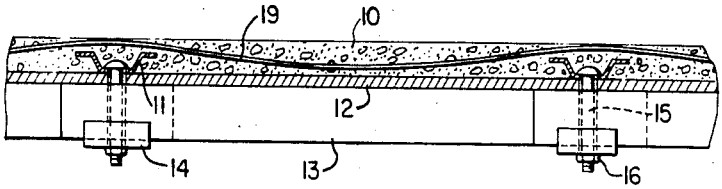
FIG. 2 is a side elevation in partial section of the system shown in FIG. 1.

This arrangement can also be seen from FIG. 2 and with the formwork in place, cement slurry mix is poured to form slab 10 embedding the reinforcing and support section 11. The concrete slab is further reinforced by the addition of a wire mesh 19.

It will be seen particularly from FIG. 2 that after the concrete slab has set, the formwork may be removed by removing the nuts 16 and removing the plates 14, wooden beams 13 and the plywood 12. The bolts then remain in place.

Figure 3:
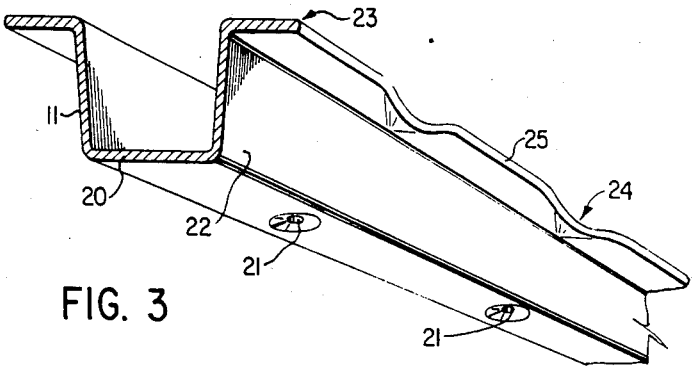
FIG. 3 is a perspective view of a preferred form of reinforcing and support section of the invention.

A particularly preferred reinforcing and support section of the invention is illustrated in FIG. 3. Thus, the section 11 comprises an elongated unitary strip having a substantially flat central web 20 containing a plurality of placed holes 21. A pair of substantially flat leg portions 22 extend away from the sides of the web and an edge flange or chord 23 extends outwardly from the outer end of each leg portion. Each flange or chord 23 has a series of longitudinally spaced round depressions of small radius 24 pressed downwardly therein with the portions of the flanges 25 between the depressions being upwardly bowed. This double curvature arrangement along the flanges or chords 23 provides a mechanical interlock with the concrete in both longitudinal and lateral directions, while providing considerable shear strength and rigidity for the entire floor structure.

Figure 4:
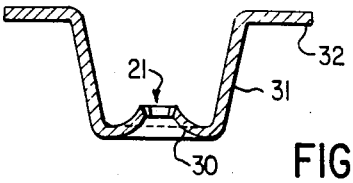
FIG. 4 is a sectional end elevation of the beam of FIG. 3.
Figure 5:
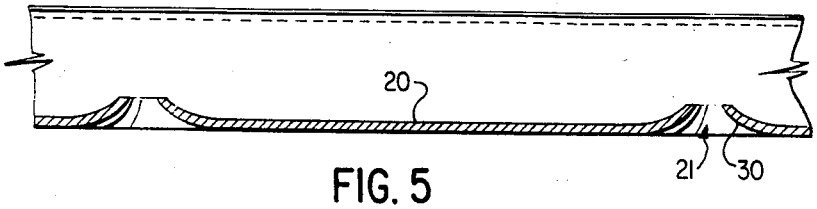
FIG. 5 is a sectional side elevation of the beam of FIG. 3.

According to a preferred feature the holes 21 also are of a particular shape as can best be seen from FIGS. 4 and 5. Thus, each hole 21 is pressed upwardly into the flat central web 20 such that rounded portions 30 surround the hole 21. These serve as indentations into the concrete slab to provide a further mechanical interlock and also provide a considerably reinforced support for each bolt 15 extending through each hole 21. As will be seen from FIG. 4, extending away from central web 20 are a pair of leg portions 31, these being preferably flared outwardly. The outer ends of these leg portions 31 terminate in outwardly extending flanges or cords 32 which have been described in greater detail in relation to FIG. 3.

Figure 6:
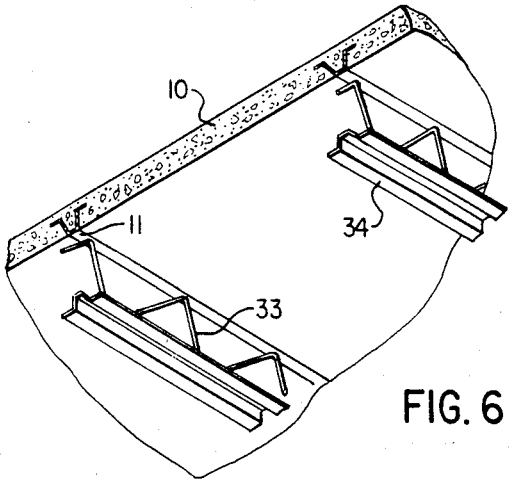
FIG. 6 is a perspective view of an open web joist system embodying the present invention and FIG. 7 is a side elevation in partial section showing an open web joist according to the invention.
Figure 7:
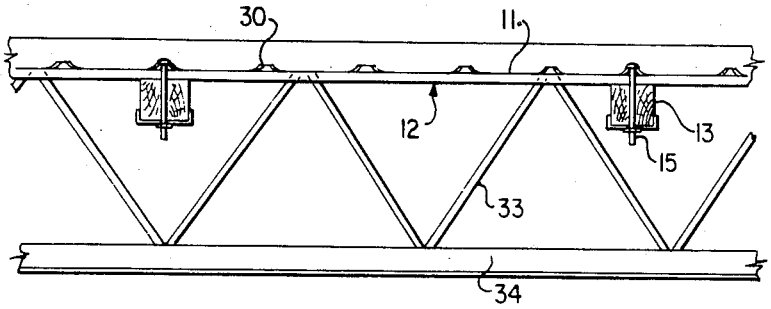

According to another feature of the present invention, the reinforcing and supporting section 11 forms the upper chord of an open web joist. This will better be seen from FIGS. 6 and 7 with each joist including a web portion 33 and a bottom chord 34.

Again as in the previous embodiments, the reinforcing and supporting section 11 has the contoured upper flanges 23 and the central web holes 21 supporting bolts 15. In this case, the bolts 15 are being used to support plywood formwork 12 and wooden beams 13 for the pouring of the concrete slab. After the slab has set, the nuts 16 may be removed from the bolts 15 and the plates 14 and wooden beams 13 removed. The bolt, of course, remains in place hanging down into the joist where it can do no harm.

I claim:

1. A composite floor system comprising a concrete slab and a metallic reinforcing and support section mechanically embedded in said slab, said support section comprising an elongated unitary strip having a substantially flat central web portion containing a plurality of spaced holes, a pair of substantially flat leg portions extending away from the sides of said web, and an edge flange extending outwardly from the outer end of each leg portion and at least the leg portions and the edge flanges being embedded in the concrete with the web being adjacent a face of the slab and support bolts mounted within said web portion holes and extending outwardly from said slab, said edge flanges being mechanically interlocked with the concrete in both longitudinal and lateral directions, providing shear strength and rigidity for the floor system.

2. A floor system according to claim 1 wherein said bolts support formwork for receiving a cement and aggregate slurry to make the concrete slab.

3. A floor system according to claim 2 wherein the formwork comprises wood panels supported by wooden beams which are supported by said bolts.

4. A floor system according to claim 3 wherein said formwork is mounted to permit removal after the concrete slabs are self-supporting.

5. A floor system according to claim 1, wherein said elongated unitary strip comprises one chord of an open web joist.

* * * * *